United States Patent [19]

Loftis et al.

[11] 4,190,119

[45] Feb. 26, 1980

[54] EARTH DRILLING APPARATUS

[75] Inventors: James B. Loftis; Norlin O. Lewis, both of Remlap, Ala.

[73] Assignee: Joy Manufacturing Company, Pittsburgh, Pa.

[21] Appl. No.: 859,613

[22] Filed: Dec. 12, 1977

[51] Int. Cl.[2] ..... B23Q 5/00; E21C 5/00

[52] U.S. Cl. ..... 173/149; 173/140; 173/163; 175/220

[58] Field of Search ..... 173/1, 140, 145, 146, 173/147, 149, 152, 163, 164, 148; 175/85, 220; 166/77 254/29 R; 279/4, 107, 37

[56] References Cited

U.S. PATENT DOCUMENTS

| | | | |
|---|---|---|---|
| 853,010 | 5/1907 | Gray | 175/220 X |
| 853,018 | 5/1907 | Lamb et al. | 173/145 |
| 1,105,565 | 7/1914 | Judge | 279/107 X |
| 1,338,948 | 5/1920 | Miller | 173/145 |
| 1,486,247 | 3/1924 | Hunter | 173/145 |
| 2,255,241 | 9/1941 | Brown | 173/40 |
| 2,309,999 | 2/1943 | Vanderzee | 92/61 |
| 2,327,616 | 8/1943 | Abramson et al. | 173/163 X |
| 2,527,255 | 10/1950 | Hunt | 175/85 X |
| 2,781,185 | 2/1957 | Robbins | 175/220 X |
| 2,849,212 | 8/1958 | Robbins | 173/57 |
| 2,904,310 | 9/1959 | Leonard | 173/27 |
| 3,012,619 | 12/1961 | Farque | 173/145 X |
| 3,212,591 | 10/1965 | Tucker | 173/149 |
| 3,466,971 | 9/1969 | Meyer | 279/37 X |
| 3,696,872 | 10/1972 | Jonsson | 173/149 |
| 3,754,605 | 8/1973 | Porter et al. | 173/57 |
| 3,792,869 | 9/1974 | Braun | 279/4 |
| 3,973,634 | 8/1976 | Persson et al. | 173/147 |

FOREIGN PATENT DOCUMENTS

| | | | |
|---|---|---|---|
| 652931 | 9/1964 | Belgium | 173/164 |
| 1149478 | 4/1969 | United Kingdom | 175/220 |

*Primary Examiner*—Lawrence J. Staab
*Attorney, Agent, or Firm*—Michael R. Swartz

[57] ABSTRACT

An earth drilling method and apparatus utilizes a unique drill string rotary drive and support arrangement which provides for the utilization of longer drill strings than could heretofore be accommodated on prior art drill masts of equal height.

3 Claims, 4 Drawing Figures

45
44
46
40b
34
144
28
30
26
143
40c
40
14
18
10
40a
46
22
24
16
142
141
12
36
42
20

34
138
130
142
136
134
132
140

EARTH DRILLING APPARATUS

BACKGROUND OF THE INVENTION

The present invention relates to earth drilling machines, and more particularly, to an improved method and apparatus for driving and supporting drill strings.

Earth drilling machines are commonly used for drilling blast holes that are associated with strip mining, highway construction, and the like, or, for the drilling of water wells, as well as other uses. Known rotary earth drilling machines (such as those shown and described in U.S. Pat. Nos. 2,309,999; 2,849,212, 2,904,310; and 3,754,605) basically comprise a mobile frame, a mast pivotally mounted on the frame, a rotary drive carried on the mast, a drill pipe (or string of pipes connected together) connected at one end to the rotary drive and having its other end supporting a drill or other pipe bit and means for raising and lowering the rotary drive and therewith the drill pipe and its associated drill bit. Such arrangement of components, coupled with a conventional power means, provides both torque and downward force on the drill bit to thereby bore a hole in the earth. It should be pointed out here, that throughout this specification, a drill string means a drill pipe or series of drill pipes connected together.

Generally, in the majority of drilling operations, the mast is positioned in a generally vertical upright position; however, the mast may be positioned at any desired angle from horizontal to vertical during the drilling operation such as shown in U.S. Pat. No. 2,255,241.

Initially, in the drilling process, the rotary drive is positioned at the top of the mast with the drill pipe projecting downwardly therefrom to the attached drill bit which is resting on the top of the ground. Upon operation, the drive is rotated, imparting rotational movement to the drill pipe and the drill bit. Simultaneously therewith, the rotary drive is lowered along the mast, thus providing a downward force on the drill bit.

As the maximum length of the drill pipe, of the prior art drilling machines, is generally limited to the height of the drill mast, the depth of a bore hole is limited to the length of a single drill pipe; however, if the desired bore depth is to be greater than the single drill pipe, it is necessary to add additional drill pipes to the first drill pipe, thereby forming a drill string. Such operation requires the rotary drive to be disconnected from the initial drill pipe, raised to the top of the mast, at which time another drill pipe is introduced between and connected to the rotary drive and the first drill pipe. The above drilling process is then repeated until the desired bore depth is obtained. Sometimes, this requires the drill pipe connect-disconnect steps to be repeated several times. After the desired bore depth is reached, the drill string is removed from the bore hole and the drill pipes are disconnected separately. This drill pipe/string removal operation may be accomplished in many ways; for example, one way is by the utilization of a winch and pulley arrangement on the top of the mast. Such prior art drilling technique of connecting and disconnecting drill pipes involves a large amount of time and labor which considerably adds to the cost of drilling each hole. One way to decrease the number of connect-disconnect steps is to use a larger drilling machine with a higher mast; however, such machines are more expensive and more cumbersome to maneuver.

SUMMARY OF THE INVENTION

Accordingly, it is one of the principal objects of the present invention to provide an earth drilling machine with an improved rotary drive means which may advantageously utilize drill pipes/strings of pipes of a length greater than the height of the drill mast, thereby decreasing the number of drill pipe connect and disconnect steps associated with the prior art drilling machines to drill a bore hole of a desired depth, which thereby reduces the amount of time and labor involved in drilling each hole, and thus, resulting in a reduction of cost.

In furtherance thereof, the present invention provides an earth drilling machine having a frame and a mast mounted thereon, with an improved rotary drive means for rotating a drill pipe which is of a length greater than the height of the mast and for removing the drill pipe after the drilling operation is completed.

More particularly, the rotary drive means is carried on the drill mast and is adapted to reciprocate therealong. Specifically, the rotary drive means includes a drill pipe engaging means having a generally axially oriented bore adapted to receive a drill pipe therewithin. The pipe engaging means is adapted to engage the drill pipe to impart rotary motion thereto during the drilling operation.

Preferably, the drill pipe engaging means includes a plurality of pivotally mounted latches that mate with corresponding notches provided on the outer surface of a drill pipe to secure the drill pipe within the rotary drive means.

The invention further includes a drill pipe centralizer, preferably located at the upper end of the mast, for providing stability to a drill pipe or string of a length longer than that of the drill mast.

Still further, the invention includes a clamping device, preferably located at the lower portion of the drill mast, to assist in removing the drill pipe/string from a bore hole.

The improved rotary drive means of the present invention enables a standard rotary earth drilling machine, having a given height drill mast, to utilize a drill string of greater length than the drill mast, thus reducing the cost of each hole drilled as fewer drill pipes are needed to reach the same depth. Another advantage, according to the present invention, is that a smaller drilling machine, which is less costly and more easily manueverable, can be utilized to drill a hole of an equal depth to that of a prior art machine, since a shorter mast requires a smaller frame to provide equal stability to that of a machine having a larger mast.

Still another advantage of the present invention is that it is readily adaptable to be made fully automatic by providing conventional automatic controls wherein the drill operation could be continuous without as many interruptions due to the steps of connecting and disconnecting the drill pipes to the rotary drive means as is customary with the drilling operations of the prior-art machines.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

In the following description, right-hand and left-hand references are determined by standing at the rear of the machine facing in a direction of forward travel. Also, in the following description, it is to be understood that such terms as "forward", "rearward", "left", "upwardly", and the like, are words of convenience and are not to be construed as limiting terms.

IN GENERAL

Figures 1, 4:
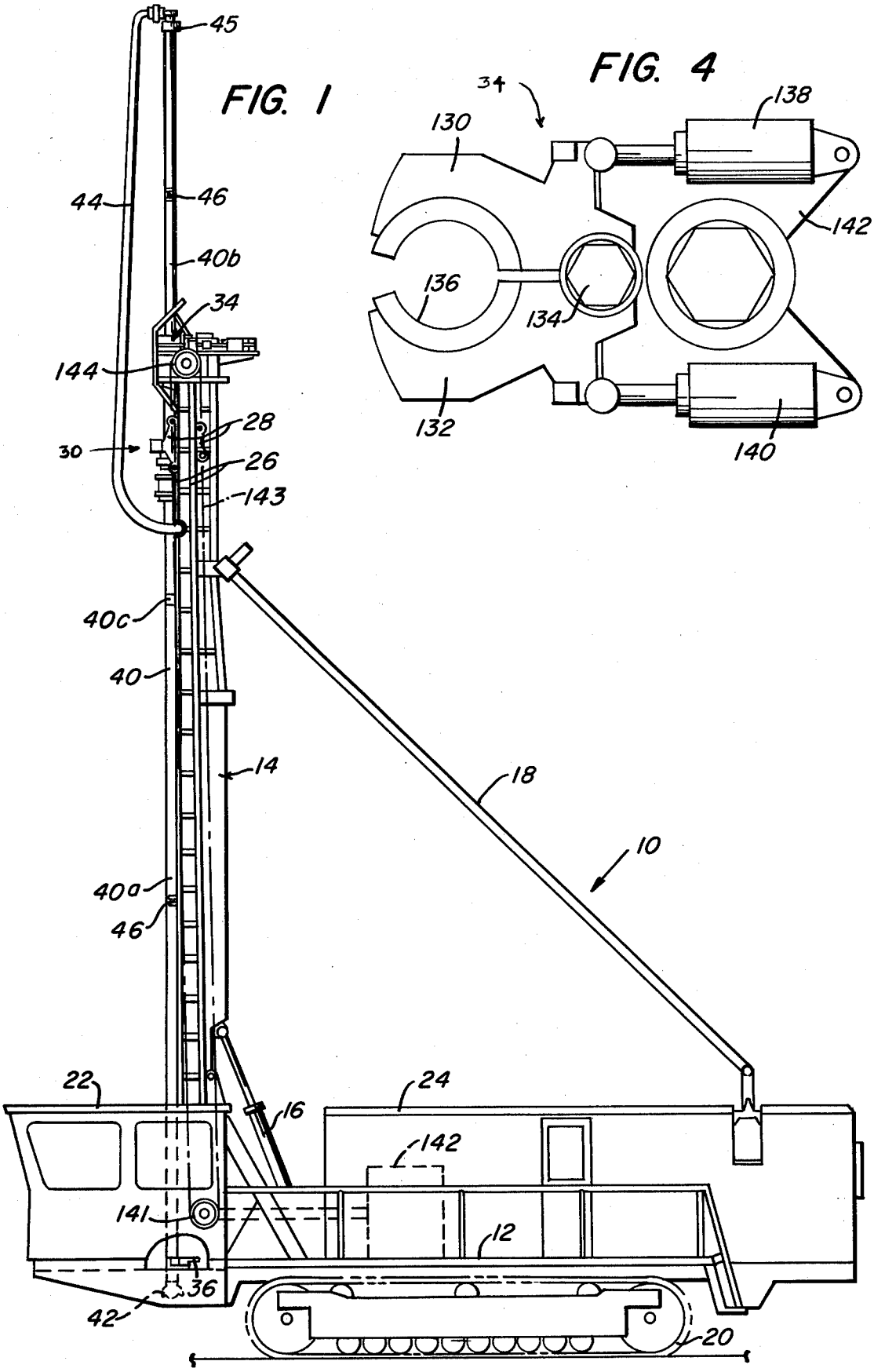
FIG. 1 is a diagramatic side view of an earth drilling machine which incorporates the present invention, the mast being shown in an upright vertical position.
FIG. 4 is a top plan view of the drill pipe centralizer.

Referring now to the drawings, and particularly to FIG. 1, there is shown a mobile earth drilling machine, being indicated generally by the numeral 10, which incorporates a preferred embodiment of the present invention. While the illustrated earth drilling machine is mounted on a track or crawler-type frame for mobility, it should be understood that the invention is not so limited to a mobile frame, but is equally applicable to an earth drilling machine of the stationary type.

The earth drilling machine 10 generally includes a support frame 12, a mast 14 rotatably mounted on the support frame 12, an operator's cab 22 positioned on the forward portion of the frame 12 and a machinery house 24 extending over the central and rear portions of the frame 12. Conventional crawlers 20 are provided on the frame 12 to render the machine 10 mobile. The mast 14 includes a pair of spaced-apart guide rails 26 which are pivotally mounted at their lower ends on the frame 12. A pair of hydraulic cylinders 16 (only the left one being shown) pivotally interconnected between the guide rails 26 and the frame 12 are provided to raise and lower the mast 14 from a lowered horizontal transport position (not shown) to a raised upright generally vertical position as shown in FIG. 1. Collapsible braces 18, extending between the mast 14 and the machinery house 24, are provided for stability to thereby secure the mast 14 in any one of its selective positions between its horizontal transport and its vertical upright positions.

Slidably mounted on guide rails 26 of mast 14, by means of roller assemblies 28, is the rotary drive means generally indicated by the numeral 30. A drill pipe centralizer 34 is located at the upper portion of the mast 14 whereas a securing clamp 36 is located at the lower portion of the mast 14, preferably adjacent the support frame 12. The rotary drive means 30, the centralizer 34, and the securing clamp 36 all include portions in axial alignment adapted to cooperate with a drill string.

Further seen in FIG. 1 is a drill string 40, positioned adjacent the forward portion of the mast 14 and extending upwardly beyond the top of the mast and downwardly below the bottom or lower edge of the mast. The drill string 40 is comprised of two generally cylindrical and hollow drill pipes, **40*a* and 40*b*, coupled together by a union 40*c*. Mounted on the lower end of drill pipe 40*a* is a drill bit 42. Drilling fluid is supplied, in a conventional manner, to the bit 42 through a supply hose 44 which is connected to a fluid connector 45 located on the upper end of drill pipe 40*b*. Each of the drill pipes 40*a*, 40*b* of drill string 40 is provided with indentations or notches 46, preferably formed in the exterior walls thereof. The notches 46 are so positioned on each of the drill pipes 40*a*, 40*b* such that a predetermined spacing exists between successive notches when the drill pipes are coupled together to form the drill string 40. The purpose of the notches 46 will be apparent from the forthcoming description of the novel rotary drive means 30**.

The rotary drive means 30 is adapted to reciprocate on guide rails 26 and may be selectively positioned along substantially the entire length of the mast 14 (between upper centralizer 34 and lower locking clamp 36) by a known assembly being schematically represented by a drive sprocket 141, a motor 142, an idler sprocket 144, and a chain 143 entrained around the sprockets 141 and 144. Chain 143 is also connected to the rotary drive means 30 in a known manner and, as can be seen from FIG. 1, the drive means 30 will be raised or lowered depending upon the direction of rotation of sprocket 141.

IMPROVED ROTARY DRIVE MEANS

Now, in reference to FIGS. 2 and 3, a more detailed description of the novel rotary drive means 30 will be given. The rotary drive means 30 includes a non-rotable housing 50 and an elongated rotor 52 rotatably supported therein by suitable roller bearings 54. The rotor 52 is provided with an axial extending bore 56 of a diameter greater than the outside diameter of the drill string 40 to thereby enable the drill string 40 to pass therethrough.

Figure 2:
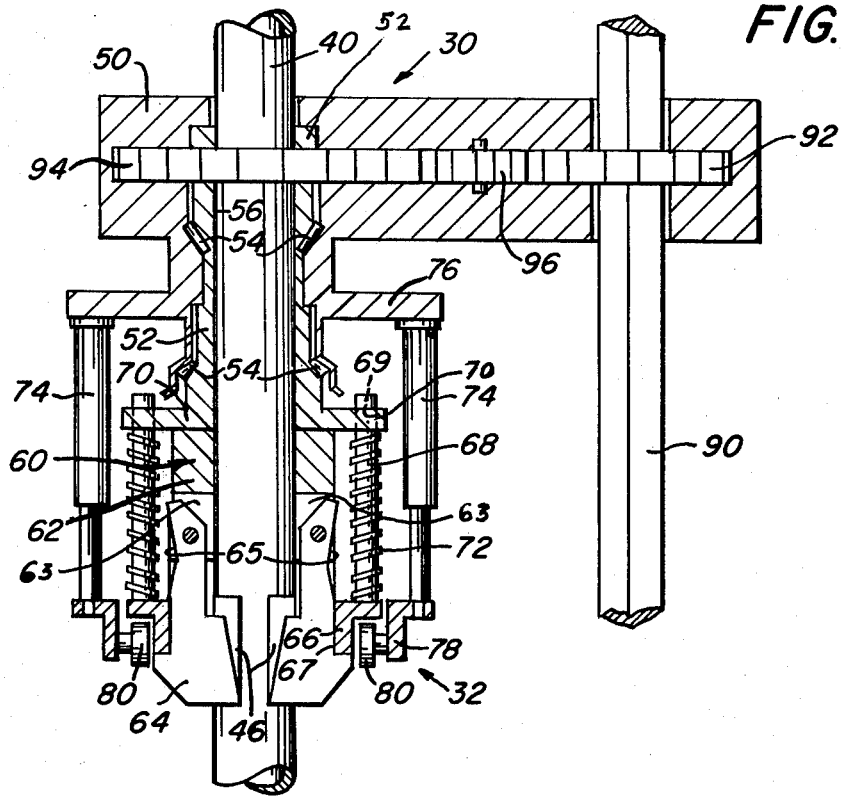
FIG. 2 is an enlarged fragmentary cross-sectional view of the rotary drive means with the engaging means being in an engaged position.

The linkage for supplying rotary power to the drive rotor 52 is conventional and basically includes, in the preferred embodiment, a square shaped drive shaft 90 (as seen in FIG. 2, but not shown in FIG. 1). Shaft 90 is connected at its lower end to a suitable power means (not shown), located on frame 12, and extends upwardly therefrom along mast 14. Mounted within the housing 50 of rotary drive means 30 is a primary gear 92 which is provided with an axial square shaped bore to mate in operable relationship with shaft 90. Upon rotation of shaft 90, gear 92 through a suitable transmission gear 96 drives rotor gear 94, which is keyed to rotor 52. The drive arrangement is such that as the rotary drive means 30 reciprocates along guide rails 26, gear 92 reciprocates along shaft 90, thereby providing rotational power at any and all given locations along mast 14.

Extending below and secured to the rotor 52 is the drill pipe engaging means generally indicated by the numeral 32. The engaging means 32 basically includes a chuck 60 having an upper cylindrical base portion 62 and a plurality of integrally formed legs 63 extending downwardly therefrom that pivotally mount a corresponding number of latches 64, only two of which are shown. The base portion 62 is affixed, by suitable means, to the lower portion of the rotor 52 and has an axial bore equivalent in diameter to the rotor bore 56. The engaging means 32 further includes an annular actuating ring 66 which is mounted by a plurality of guide rods 68 that are fastened at one end to the ring 66 and extend upwardly therefrom and pass through aligned holes 69 provided in an outwardly extending lower flange portion 70 of the rotor 52. Wrapped around each of the guide rods 68 and extending between the lower surface of flange 70 and the upper surface of ring 66 is a coil spring 72. The coil springs 72 tend to move the ring 66 downwardly whereas a plurality of actuators 74 are provided to counteract the spring force and move the ring 66 upwards. Preferably, the actuators 74 are pneumatic or hydraulic cylinders, each having its cylinder-end mounted to the underside of an outwardly extending annular flange 76, located on the lower portion of housing 50, and its piston-rod end fixed to a roller assembly 78 that rotatably support rollers 80. The annular ring 66 rests on the top surface of the rollers 80.

Figure 3:
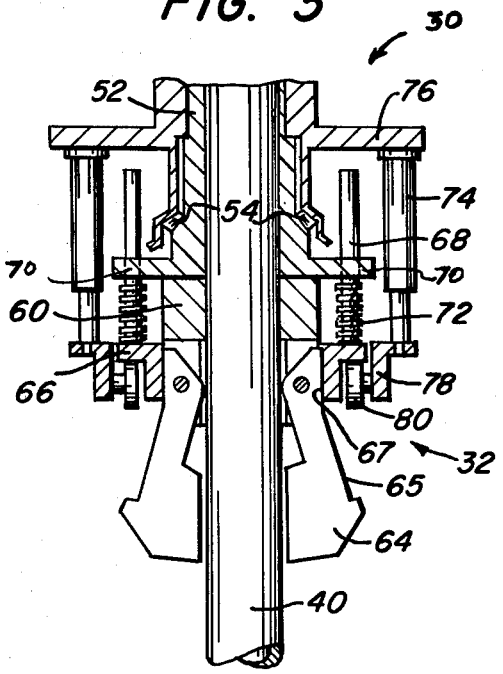
FIG. 3 is a view similiar to FIG. 2, showing the lower portion of the rotary drive means with the engaging means in a disengaged position.

Thus, it can be readily understood, from the above description, that the annular ring 66, being connected to the rotor 52 by guide rods 68, will rotate with the rotor 52 upon rotation of the rotor; and further, that the ring 66 will move upwardly toward the flange 70 of rotor 52, compressing coil springs 72, upon actuation of the actuators 74 wherein the piston-rods thereof are retracted (as shown in FIG. 3); and still further, that the annular ring 66 will be forced downwardly upon expansion of the compressed springs 72 as the actuators 74 are released (as shown in FIG. 2). The operation of the engaging means 32 of rotary drive means 30 is such that upon actuation of actuators 74, the ring 66 is forced upwardly by rollers 80, thereby compressing springs 72. As the ring 66 moves up from its engaged position as shown in FIG. 2 to its disengaged position, as shown in FIG. 3, the inner surface 67 of the ring slides against the camming surface 65 of latch 64, thereby pivoting the same and thus forcing the lower portion of the latches 64 to move outwardly, disengaging the same from the notches 46 of the drill string 40. Likewise, when the actuators 74 are released, the compressed springs 72 force the ring 66 downwardly whereby the inner surface 67 thereof slides over surface 65 of latch 64 to thereby force the lower portion of the latch inwardly into engagement with the notches 46 of the drill string 40 (see FIG. 2). Although, the engaging means has been shown as an unitary part of the drive means 30, it could easily be separated therefrom and positioned below the rotor 52.

DRILL PIPE CENTRALIZER AND SECURING CLAMP

In the preferred embodiment, as seen in FIGS. 1 and 4, the drilling machine 10 further includes a drill pipe centralizer 34 located on the upper, preferably the top portion of the mast 14. As best seen in FIG. 4, the centralizer 34 includes a pair of jaws 130 and 132 pivotally connected at a pivot 134 in thus defining therebetween, in the closed position, an axial bore 136 which is adapted to slidably receive a drill string; such as string 40. Pivotally mounted hydraulic cylinders 138, 140 interconnect the respective jaws 130 and 132 to a support 142 that is fastened to the upper extremities of the mast 14. The cylinders 138, 140 operate to pivot the jaws 130, 132 between an open position (not shown) and a closed position as seen in FIG. 4.

Again referring to FIG. 1, being schematically illustrated near the bottom of mast 14 is a securing clamp 36. The clamp 36 has not been shown in detail as it may be of a structure substantially identical to the above-described centralizer 34 with the exception that the jaws of the clamp 36 are so adjusted so as to engage and hold the drill string 40 in a closed clamping position whereas the jaws 130, 132 of the centralizer 34 in the closed position only slightly embrace the drill string for stability, allowing the same to pass therethrough during the drilling operation.

OPERATION

The operation of the drilling machine 10 will now be discussed in further detail with reference to FIGS. 1–4. When the machine 10 is in its drilling site position, the cylinders 16 are actuated, pivoting the mast 14, from its horizontal transport position, upwardly to an upright vertical drilling position as seen in FIG. 1. It should be pointed out here that the drilling machine 10 can be rendered operational, incorporating the present invention, with the mast 14 positioned at any angle of inclination between its horizontal transport position and its vertical upright position; however, for illustrational purposes only, the following description of the operation will be made with reference to the mast 14 in a vertical upright position.

Initially, the rotary drive means 30 is positioned on the lower part of the mast 14 and the centralizer 34, located at the top of the mast 14, is opened, thereby allowing a drill string 40 to be loaded; such as, by a conventional drill string loader (not shown). With the centralizer jaws 130, 132 open and with latches 64 of the drill pipe engaging means 32 in a disengaged position as shown in FIG. 2, the drill string 40 is loaded on the mast 14 with the upper portion of drill string 40 extending between jaws 130, 132 and the lower portion being passed through the axial bore 56 of the rotary drive means 30; the jaws 130, 132 of centralizer 34 are then closed around the drill string 40. The drill bit 42 is then secured to the lower end of the drill string 40 and the fluid hose 44 and associated connector 45 are attached to the top of the string 40.

To begin drilling, the latches 64 of the engaging means 32 are opened and the rotary drive means 30 is raised upwardly, along the drill string 40, to the top of the mast 14 by operation of the above-described conventional drive assembly 141, 142, 143, and 144. With the rotary drive means 30 in the raised position, the actuators 74 are released, causing the compressed coil springs 72 (FIG. 3) to extend thereby forcing the annular ring 66 downwardly against rollers 80, which in turn, extends the piston-rods of the actuators 74. As the drive shaft 90 is rotated, the rotor 52 of rotary drive means 30 is caused to rotate through the aforesaid drive transmission gearing 92, 94, and 96. Upon rotation of rotor 52, the engaging latches 64 are forced into engagement with the notches 46 of pipe string 40 by the camming effect of the latch surface 65 with the surface 67 of the annular ring 66.

With the latches 64 engaged in the notches 46, the drill string 40 rotates along with the rotation of the rotor 52, and thus, as the housing 50 is lowered, the rotating drill string 40 and the drill bit 42 therewith is fed into the earth. As the connector 45, on top of the drill string 40, approaches the centralizer 34, (as bit 42 bores downwardly into the earth) the centralizer cylinders 138, 140 are actuated to open jaws 130, 132 to thereby permit the connector 45 to pass unobstructed thereby. The actuation of cylinders 138 and 140 may be automatic as by providing a suitable sensing means (not shown) to sense the approach of the connector 45.

When rotary drive means 30 reaches the bottom of the mast 14, the actuators 74 are energized whereby the piston-rods are retracted, causing the rollers 80 to force the ring 66 upwardly from its position in FIG. 2 to its position in FIG. 3. The upward movement of ring 66 compresses springs 72 and disengages the latches 64 from the drill pipe notches 46. The rotary drive means 30 is then raised to the top of the drill string 40 where again the latches 64 are engaged in notches 46 and the described drilling process is repeated.

When substantially the entire length of the drill string 40 is in the earth, another drill string may be positioned in the drilling machine 10 in the manner explained hereinabove and connected to the top of the first drill string to form a new longer drill string. The above drilling process is then repeated until a hole of the required depth has been bored.

After the desired bore depth is obtained, the drill string is removed from the bore hole. This removal operation is accomplished by raising the rotary drive means 30 to the top of the mast 14 while the latches 64 of the pipe engaging means 32 are still in engagement with the notches 46 of the drill string, thus, pulling the drill string upwardly. The securing clamp 36, at the bottom of the mast 14, is then actuated to hold the drill string in said raised position to thereby prevent the same from falling back into the bored hole. With the clamp 36 secured, the latches 64 are disengaged and the rotary drive means 30 is lowered to the bottom of mast 14 whereagain the latches 64 are engaged with notches 46 on a lower portion of the drill string. Clamp 36 is then disengaged and the rotary drive means 30 is again raised to the top of the mast 14, pulling the drill string further upwardly from the bore hole. As the entire drill string is being removed from the ground, the separate drill strings or pipes are disconnected in a manner substantially the reverse of the loading thereof. The above removal steps are repeated until the entire drill string is removed from the bore hole.

The novel earth drilling method and apparatus as described above provides a drilling machine with the capability of utilizing a drill string that is longer than the height of the drill mast, thus reducing the number of drill string connecting and disconnecting steps to drill a hole of a predetermined depth. Further, in accordance with the principles of the present invention, a predetermined depth bore hole can be drilled with a drilling machine smaller in size, than that of the prior art, employing a shorter drill mast and a smaller lighter base frame structure which are both less expensive to manufacture, thereby reducing the cost of a drilling machine and thus reducing the cost of drilling each hole. Still further, the present invention enables a smaller drilling machine to utilize the standard drill strings associated with larger machines having higher masts.

While the preferred structure in which the principles of the present invention have been incorporated, is shown and described above, it is to be understood that the invention is not to be limited to the particular details as shown and described, but that, in fact, widely different means may be employed in the practice of the broader aspects of the invention.

Having thus described the invention, what is claimed is:

1. An improved drilling machine comprising:

a frame;

an elongated drill mast having one end connected to said frame;

a rotary drive means adapted to reciprocably move on at least a major portion of said mast and having an axis of rotation disposed generally parallel to said mast and including an elongated rotor having a through bore coaxial with said axis of rotation for receiving therewithin a longitudinally extending drill string of a length greater than the height of said mast, said drill string being provided with pairs of rectangular shaped notches longitudinally spaced there along;

said rotary drive means further including a pair of oppositively disposed pivotable latches mounted on said rotor and an actuator assembly selectively moveable between first and second positions, said latches being adapted to mate with said notches, movement of said assembly to its first position pivots said pair of latches into mating relationship with a corresponding pair of said drill string notches thereby providing positive engagement of said rotary drive means with said drill string whereby rotational and longitudinal motion are imparted to said drill string under conditions wherein said rotary drive means is reciprocably moved along said mast, movement of said assembly to its second position pivots said latches out of engagement with said notches such that said rotary drive means is free to move along said drill string as it is reciprocated along said mast during the drilling operation; and means for reciprocating said rotary drive means along said mast.

2. The improved drilling machine as defined in claim 1, wherein:

said actuator assembly includes a longitudinally reciprocable actuator ring situated coaxially with said bore and rotatably with said rotor about said axis;

spring means urging said actuator ring into said first position wherein said latches are cammed into said first position thereof; and, power means for selectively moving said actuator ring against the force of said spring means to said second position wherein said latches are cammed into said second position.

3. The improved drilling apparatus as defined in claim 2, wherein:

said power means comprise fluid powered extensible piston-cylinder assemblies, each having one end thereof nonrotatably carried by said rotary drive means and each including roller members on the other end thereof; and, said roller members are adapted to engage said actuator ring to move said actuator ring to said first position thereof.

* * * * *